US011217203B2

(12) United States Patent
Kim et al.

(10) Patent No.: US 11,217,203 B2
(45) Date of Patent: Jan. 4, 2022

(54) DISPLAY APPARATUS AND METHOD OF CONTROLLING THE SAME

(71) Applicant: Samsung Electronics Co., Ltd., Suwon-si (KR)

(72) Inventors: Ji Hyae Kim, Suwon-si (KR); Byoung Hyun Kim, Suwon-si (KR); Young In Park, Suwon-si (KR); Joo Sun Moon, Suwon-si (KR); Sang Young Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/716,956

(22) Filed: Dec. 17, 2019

(65) Prior Publication Data

US 2020/0202810 A1 Jun. 25, 2020

(30) Foreign Application Priority Data

Dec. 21, 2018 (KR) ..... 10-2018-0167809

(51) Int. Cl.
*G09G 5/10* (2006.01)
*G09G 5/02* (2006.01)

(52) U.S. Cl.
CPC ..... *G09G 5/026* (2013.01); *G09G 2320/0666* (2013.01); *G09G 2354/00* (2013.01)

(58) Field of Classification Search
CPC ... G09G 2320/0242; G09G 2320/0626; G09G 5/10; G09G 2320/0233; G09G 2320/0693; G09G 5/026; G09G 3/006; G09G 2320/0666; G09G 2354/00; G09G 5/02; G09G 3/2003; G09G 2340/0464; G09G 5/14; G09G 3/003; G09G 2320/0613; G09G 2340/0442; G09G 2360/144;
(Continued)

(56) References Cited

U.S. PATENT DOCUMENTS

2008/0036976 A1* 2/2008 Han ..... G03B 21/08 353/69
2008/0298688 A1 12/2008 Cheong et al.
(Continued)

FOREIGN PATENT DOCUMENTS

KR 10-2015-0111725 10/2015
KR 10-2016-0044285 4/2016
KR 10-1764998 8/2017

OTHER PUBLICATIONS

International Search Report dated Apr. 20, 2020 in International Patent Application No. PCT/KR2019/018252.

*Primary Examiner* — Duc Q Dinh
(74) *Attorney, Agent, or Firm* — Staas & Halsey LLP

(57) ABSTRACT

A display apparatus includes a communication circuitry configured to communicate with an external device; a display; and a controller configured to perform pairing with the external device, to control the communication circuitry to receive an image around the display apparatus captured by the external device from the paired external device, to apply a plurality of colors selected based on color data of the plurality of colors extracted from the received image, to a plurality of predetermined regions, to generate an image based on the plurality of regions to which the selected plurality of colors are applied, and to control the display to display the generated image.

18 Claims, 6 Drawing Sheets

(58) Field of Classification Search
CPC ..... G09G 2360/16; G09G 3/20; G09G 5/024; G09G 2340/00; H04N 5/2253; H04N 5/2254; H04N 17/045; H04N 1/6033; H04N 1/6052; H04N 5/23218; H04N 1/407; H04N 1/6027; H04N 21/21805; G06F 16/5838; G06F 16/583
See application file for complete search history.

(56) References Cited

U.S. PATENT DOCUMENTS

| | | | | |
|---|---|---|---|---|
| 2009/0021469 | A1 | 1/2009 | Yeo et al. | |
| 2013/0147860 | A1* | 6/2013 | Ishida | G09G 5/10 345/690 |
| 2015/0109533 | A1* | 4/2015 | Ikeda | H04N 9/646 348/566 |
| 2018/0342224 | A1* | 11/2018 | Beon | G09G 5/10 |
| 2019/0110035 | A1* | 4/2019 | Kuwabara | B60R 1/12 |

* cited by examiner

DISPLAY APPARATUS AND METHOD OF CONTROLLING THE SAME

CROSS-REFERENCE TO RELATED APPLICATION(S)

This application is based on and claims priority under 35 U.S.C. § 119 to Korean Patent Application No. 10-2018-0167809, filed on Dec. 21, 2018 in the Korean Intellectual Property Office, the disclosure of which is incorporated by reference in its entirety.

BACKGROUND

1. Field

The disclosure relates to a display apparatus for receiving an image from an external device, and a method of controlling the display apparatus.

2. Description of the Related Art

According to the development of a technology, a display apparatus may not only display a digital image, but also perform digital image processing for manipulating the digital image to meet various purposes. The image processing may include extracting and utilizing features in the digital image or generating a new image.

For the image processing, it is necessary to quantify the attributes of the digital image or to extract the features of the digital image.

SUMMARY

Therefore, it is an aspect of the disclosure to provide a display apparatus capable of extracting at least one color from an image, and a method of controlling the display apparatus.

Additional aspects of the disclosure will be set forth in part in the description which follows and, in part, will be obvious from the description, or may be learned by practice of the disclosure.

In accordance with an aspect of the disclosure, a display apparatus includes a communication circuitry configured to communicate with an external device; a display; and a controller configured to perform pairing with the external device, to control the communication circuitry to receive an image around the display apparatus captured by the external device from the paired external device, to apply a plurality of colors selected based on color data of the plurality of colors extracted from the received image, to a plurality of predetermined regions, to generate an image based on the plurality of regions to which the selected plurality of colors are applied, and to control the display to display the generated image.

The image received from the external device may be an image including the display apparatus.

The controller may be configured to determine a color to be extracted from the image based on color data for each pixel included in the image.

The controller may be configured to extract a color corresponding to a first color data when the number of pixels including the first color data is greater than or equal to a predetermined number.

The controller may be configured to classify the color into at least one group based on color data of the plurality of colors extracted from the image, and to select the plurality of colors to be applied to a predetermined plurality of regions based on the classification result.

The controller may be configured to compare the color data of each of the first color and a second color extracted from the image, and to classify the first color and the second color into the same group based on the comparison result.

The controller may be configured to determine the group to be assigned to a lowest region and a highest region based on the brightness of the group, and to select the color to be applied to the lowest region and the highest region based on the color included in the determined group.

The controller may be configured to determine a group having the highest brightness as a group to be assigned to the lowest region, and to determine a group having the lowest brightness as a group to be assigned to the highest region.

The controller may be configured to determine a group having the second highest brightness as a group to be assigned to the lowest region when the number of groups is greater than the number of regions.

The controller may be configured to determine a group to be assigned to a middle region based on the saturation of the group, and to select a color to be applied to the middle region based on the color included in the determined group.

The controller may be configured to determine a group having the highest saturation as a group to be assigned to the first middle region disposed at the bottom of the middle region, and to determine the group having the second highest saturation as a group to be assigned to a second middle region disposed above the first middle region.

The controller may be configured to determine the group to be assigned to the middle region in order of saturation of the group among groups not assigned to the lowest region and the highest region.

The controller may be configured to select the color to be assigned to the middle region based on the color data of the group assigned to the lowest region when there are no groups not assigned to the lowest region and the highest region.

The controller may be configured to apply a predetermined weighted value to each of the plurality of regions, and to generate an image by merging the plurality of regions to which the weighted value is applied.

The display apparatus may further include an input device configured to receive from a user at least one of the number, shape, order, and weighted values of the regions, or the color data to be applied to the regions.

In accordance with another aspect of the disclosure, a method of controlling a display apparatus includes performing, by a communication circuitry, pairing with an external device; receiving, by the communication circuitry, an image around the display apparatus captured by the external device from the paired external device; applying, by a controller, a plurality of colors selected based on color data of the plurality of colors extracted from the received image, to a plurality of predetermined regions; generating, by the controller, an image based on the plurality of regions to which the selected plurality of colors are applied; and displaying, by a display, the generated image.

The method may further include determining, by the controller, a color to be extracted from the image based on color data for each pixel included in the image.

The applying of the plurality of colors selected based on color data of the plurality of colors extracted from the received image, to the plurality of predetermined regions may include classifying, by the controller, the color into at least one group based on color data of the plurality of colors extracted from the image; and selecting, by the controller, the plurality of colors to be applied to a predetermined plurality of regions based on the classification result, and applying the selected plurality of colors to the predetermined plurality of regions.

The applying of the selected plurality of colors to the predetermined plurality of regions based on the classification result may include determining, by the controller, a group to be assigned to a lowest region and a highest region based on the brightness of the group; and selecting, by the controller, a color to be applied to the lowest region and the highest region based on the color included in the determined group.

The applying of the selected plurality of colors to the predetermined plurality of regions based on the classification result may include determining, by the controller, a group to be assigned to a middle region based on the saturation of the group; and selecting, by the controller, a color to be applied to the middle region based on the color included in the determined group.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
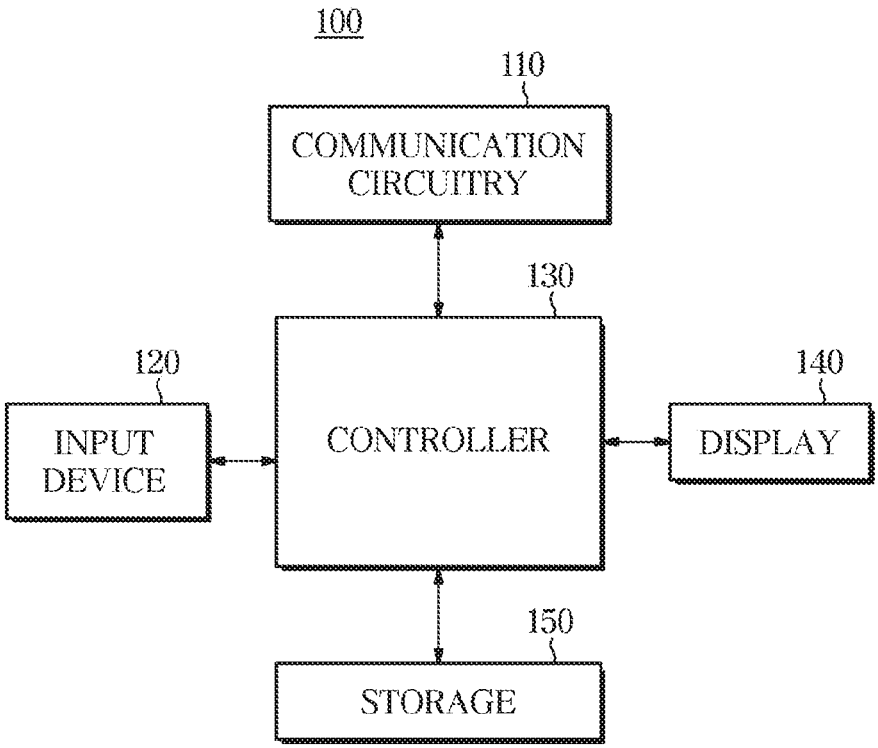
FIG. 1 is a control block diagram illustrating a display apparatus according to an embodiment of the disclosure.

Like reference numerals refer to like elements throughout the specification. Not all elements of embodiments of the disclosure will be described, and description of what are commonly known in the art or what overlap each other in the embodiments will be omitted. The terms as used throughout the specification, such as "~ part," "~ module," "~ member," "~ block," etc., may be implemented in software and/or hardware, and a plurality of "~ parts," "~ modules," "~ members," or "~ blocks" may be implemented in a single element, or a single "~ part," "~ module," "~ member," or "~ block" may include a plurality of elements.

It will be understood that when an element is referred to as being "connected" to another element, it can be directly or indirectly connected to the other element, wherein the indirect connection includes "connection" via a wireless communication network.

Also, when a part "includes" or "comprises" an element, unless there is a particular description contrary thereto, the part may further include other elements, not excluding the other elements.

It will be understood that, although the terms first, second, third, etc., may be used herein to describe various elements, it should not be limited by these terms. These terms are only used to distinguish one element from another element.

As used herein, the singular forms "a," "an" and "the" are intended to include the plural forms as well, unless the context clearly indicates otherwise.

An identification code is used for the convenience of the description but is not intended to illustrate the order of each step. Each of the steps may be implemented in an order different from the illustrated order unless the context clearly indicates otherwise.

The principle and embodiments of the disclosure will now be described with reference to the accompanying drawings.

Referring to FIG. 1, a display apparatus 100 may include a communication circuitry 110, an input device 120, a controller 130, a display 140, and a storage 150.

The communication circuitry 110 may receive an image from an external device.

In this case, the image received through the communication circuitry 110 may be an image of a surrounding environment of the display apparatus 100, and may be captured by the external device. The image of the surrounding environment of the display apparatus 100 may be an image including visual information about the surrounding environment of the display apparatus 100, and may refer to an image including the display apparatus 100 or an image that provides visual information about a place where the display apparatus 100 is installed even through the display apparatus 100 is not included.

In addition, the external device may be implemented as a computer or a portable terminal capable of communicating with the display apparatus 100 through a network, or may be implemented as a camera device.

The communication circuitry 110 may directly receive the image of the surrounding environment from the camera device, and may receive the image of the surrounding environment of the display apparatus 100 captured by the camera device from the external device such as a server.

However, the disclosure is not limited thereto, and the image received by the communication circuitry 110 may include various content images, and may receive various types of images.

In addition, the communication circuitry 110 may receive various information related to the display apparatus 100 as well as the image of the surrounding environment of the display apparatus 100, and may transmit information about the display apparatus 100 to the external device.

Further, the communication circuitry 110 may perform pairing with the external device and may receive the image of the surrounding environment from the paired external device.

The communication circuitry 110 may include one or more components that enable communication with the external device, for example, at least one of a short-range communication module, a wired communication module, and a wireless communication module.

The short-range communication module may include various short-range communication modules for transmitting and receiving signals within a short range over a wireless communication network, such as a Bluetooth module, an infrared communication module, a radio frequency identification (RFID) communication module, a wireless local access network (WLAN) communication module, a near field communication (NFC) module, and a Zigbee communication module.

The wired communication module may include not only one of the various wired communication modules, such as a controller area network (CAN) communication module, a local area network (LAN) module, a wide area network (WAN) module, or a value added network (VAN) module, but also one of various cable communication modules, such as a universal serial bus (USB), a high definition multimedia interface (HDMI), a digital visual interface (DVI), recommended standard (RS) 232, a power cable, or plain old telephone service (POTS).

The wireless communication module may include a wireless fidelity (WiFi) module, a wireless broadband (WiBro) module, and/or any wireless communication module for supporting various wireless communication schemes, such as a global system for a mobile communication (GSM) module, a code division multiple access (CDMA) module, a wideband code division multiple access (WCDMA) module, a universal mobile telecommunications system (UMTS), a time division multiple access (TDMA) module, and a long-term evolution (LTE) module.

The wireless communication module may include a wireless communication interface including an antenna and a transmitter for transmitting image signals. The wireless communication module may further include a signal conversion module for modulating a digital control signal output from the controller 130 through the wireless communication interface into an analog type wireless signal under the control of the controller 130.

The wireless communication module may include a wireless communication interface including an antenna and a receiver for receiving the image signals. The wireless communication module may further include a signal conversion module for demodulating the analog type wireless signal received through the wireless communication interface into the digital control signal.

The controller 130 may perform overall control regarding an internal configuration of the display apparatus 100.

The controller 130 may extract at least one color included in the image from the received image, and may classify the extracted at least one color into at least one group based on color data corresponding to the extracted color.

In this case, the color data may refer to data for designating a specific color, and may refer to data for representing the color of each pixel included in the image. The color data may include coordinate values of standardized color models.

In the coordinates of the color models, each of the three primary colors may form one axis. One specific color may be represented by one point in a coordinate system. The color models may include Red-Green-Blue (RGB) models, Hue-Saturation-Value (HSV) models, Cyan-Magenta-Yellow-Black (CMYK) models, Hue-Saturation-Lightness (HSL) models, and TCbCr models.

There are various types of color models depending on their purpose. The RGB model is used for color CRT monitors and computer graphics, YIQ is a color model for TV broadcasting, and CMY is a color model used in printers for outputting color images. An intuitive model that is close to a color-recognition model of humans and that is a system processing color, saturation, and brightness uses the HSV, HSL, and HIS color models.

In an embodiment of the disclosure, the HSV model and the RGB model may be used. In this case, the image received from the communication circuitry 110 may include the color data of each pixel. The color data may include data on parameter values of Red (R), Green (G), and Blue (B) of each pixel. In addition, the color data may include data on parameter values of Hue (H), Saturation (S), and Value (V).

The controller 130 may apply at least one color extracted from the image received through the communication circuitry 110 to at least one region, and may generate the image based on at least one region to which at least one color is applied. The controller 130 may control the display 140 to display the generated image.

Accordingly, the controller 130 may determine a color to be extracted from the image based on the color data for each pixel included in the image.

In detail, the controller 130 may identify the number of pixels for each color based on the color data for each pixel included in the image, and may determine the color to be extracted from the image based on the number of pixels having the same color. That is, the controller 130 may determine the color to be extracted from the image based on the number of pixels having the same color data.

When the number of pixels having the same color data is equal to or greater than a predetermined number, the controller 130 may extract the color corresponding to the corresponding color data from the image. In this case, extracting the specific color may refer to an operation of obtaining the color data corresponding to the specific color from pixel information of the image, and may further include an operation of storing the obtained color data.

The controller 130 may classify the color extracted from the image into at least one group based on the color data corresponding to the corresponding color. The controller 130 may classify similar colors among the at least one color extracted from the image into the same group. In this case, the similar color may refer to a color having similar parameter values of each color data. A detailed description thereof will be described later.

The controller 130 may determine a color to be assigned to at least one region based on the classification result of classifying at least one color included in the image into at least one group, that is, a characteristic of the group including at least one color. The controller 130 may apply the assigned color to the corresponding region. In this case, the at least one region may refer to a display region for configuring a predetermined pattern, and may refer to at least one layer for displaying a specific image. Each of the at least one region may be displayed by a predetermined size, shape, arrangement order, and depth, or may be displayed based on a size, shape, arrangement order, and depth input from the user. The pattern may be a pattern for color correction of the image output from the display 140, and may refer to an image itself output from the display 140. A detailed description thereof will be described later.

The controller 130 may generate the image by merging at least one region, and may control the display 140 to display the generated image.

In this case, the controller 130 may generate the pattern by merging at least one region, and may control the display 140 to display an image in which a color thereof is corrected based on the generated pattern.

In addition, the controller 130 may perform various image processing such as color assignment for at least one region, and correction of the assigned color, and may perform image processing based on a user command received through the input device 120.

The controller 130 may be implemented with one or more memories storing an algorithm to control the operation of the components in the display apparatus 100 or data about a program that implements the algorithm, and one of more processors carrying out the aforementioned operation using the data stored in the memory. The memory and the processor may be implemented in separate chips. Alternatively, the memory and the processor may be implemented in a single chip.

The display 140 may display a desired color by combining the three primary colors, that is, red, green, and blue, and may display the image based on the color data based on various color models.

The display 140 may display various images based on control signals of the controller 130. In this case, the display 140 may display the image received through the communication circuitry 110 as well as the image generated by the controller 130.

The display 140 may include a cathode ray tube (CRT), a digital light processing (DLP) panel, a plasma display penal, a liquid crystal display (LCD) panel, an electroluminescence (EL) panel, an electrophoretic display (EPD) panel, an electrochromic display (ECD) panel, a light emitting diode (LED) panel, or an organic light emitting diode (OLED) panel, etc., but is not limited thereto.

The input device 120 may receive at least one of the number, shape, order, weighted value of the region, or color data to be applied to the region, from the user.

The user may directly designate the color to be assigned to the region by inputting the color data to be applied to at least one region through the input device 120. The user may change the color assigned to the region by directly inputting the parameter value of the color data or by inputting the weighted value for the parameter value of the color data.

The input device 120 may include a hardware device, such as various types of buttons or switches, pedals, keyboards, mouse, track-balls, various levers, handles, or sticks for a user input.

The input device 120 may further include a graphical user interface (GUI), such as a touch pad, for the user input, that is, a software device. The touch pad may be implemented as a touch screen panel (TSP) to form a mutual layer structure together with the display.

When the display 140 is implemented by the TSP having the mutual layer structure with the touch pad, the display 140 may also be used as the input device 120.

The storage 150 may be implemented with at least one of a non-volatile memory device, such as a cache, Read Only Memory (ROM), Programmable ROM (PROM), Erasable Programmable ROM (EPROM), and Electrically Erasable Programmable ROM (EEPROM), a volatile memory device, such as Random Access Memory (RAM), or a storage medium, such as Hard Disk Drive (HDD) and Compact Disk (CD) ROM, without being limited thereto. The storage 150 may be a memory implemented in a chip separate from the processor described above in connection with the controller 130, and may be implemented as a single chip with the processor.

At least one component may be added or deleted in correspondence with the performance of the components of the display apparatus 100 illustrated in FIG. 1. It will be readily understood by those skilled in the art that the relative positions of the components may be changed corresponding to the performance or structure of the system.

Each of the components illustrated in FIG. 1 may refer to a software component and/or a hardware component such as a Field Programmable Gate Array (FPGA) and an Application Specific Integrated Circuit (ASIC).

Figure 2:
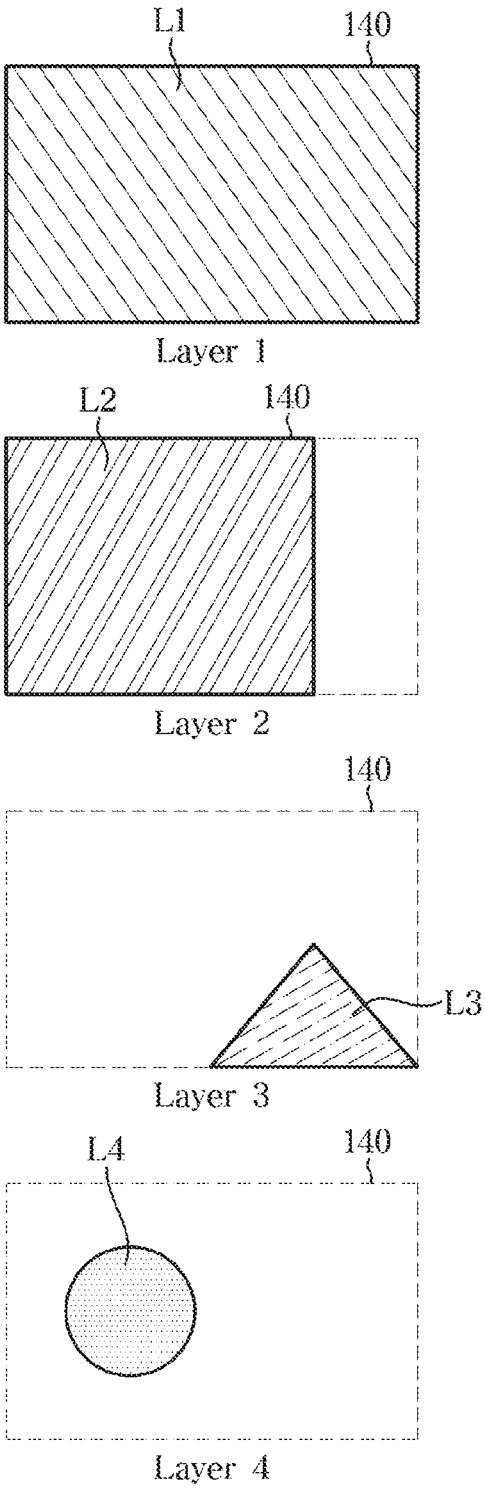
FIGS. 2 and 3 are views illustrating examples of regions included in an image displayed by a display apparatus according to an embodiment of the disclosure.
Figure 3:
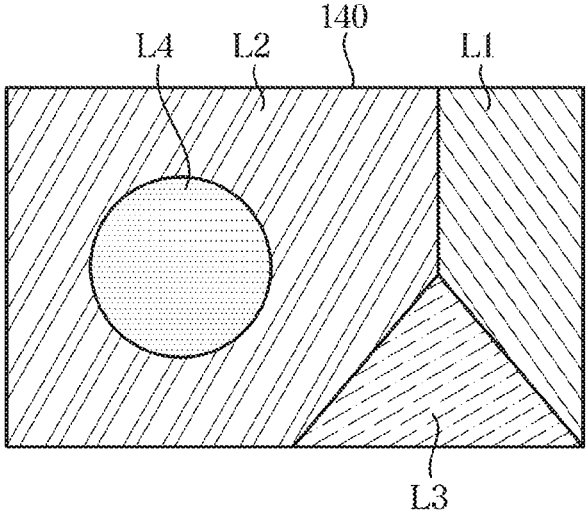

FIGS. 2 and 3 are views illustrating examples of regions included in an image displayed by a display apparatus according to an embodiment of the disclosure.

The display apparatus 100 may generate or display the image based on various patterns, and the pattern may include at least one region. As various patterns for generating or displaying the image exist, at least one region constituting the image may be formed to have various shapes, colors, arrangement orders, and depths.

For example, as illustrated in FIG. 2, the controller 130 may generate or display according to the pattern including a first region L1 disposed at the lowest region, a second region L2 disposed at an upper region of the first region L1, a third region L3 disposed at an upper region of the second region L2, and a fourth region L4 disposed at the highest region. A shape of the first region L1 to the fourth region L4 may be different from each other.

The controller 130 may generate the image by merging at least one region, and may generate the pattern for displaying the image. In this case, the controller 130 may apply a predetermined weighted value to each of at least one region, and adjust the specific weight of each region by merging regions to which the weighted value is applied.

In this case, the weighted value may refer to the weighted value for the color data to be displayed by each of at least one region, and more particularly, the weighted value for the parameter value of the color data to be displayed by each region.

For example, when the first region L1 to the fourth region L4 illustrated in FIG. 2 are merged, as illustrated in FIG. 3, the first region L1 may be disposed at the lowest region, and the second region L2, the third region L3, and the fourth region L4 may be disposed in the upper region of the first region L1 in order.

In this case, the controller 130 may merge the first region L1 to the fourth region L4 by varying the weighted values for each of the first region L1 to the fourth region L4. By the weighted values for each region, the color in the region where the regions overlap each other may be displayed differently from the color in the region that does not overlap.

Meanwhile, the weighted value may be input from the user through the input device 120, and the controller 130 may apply the weighted value for each of at least one region based on input information.

Figure 4:
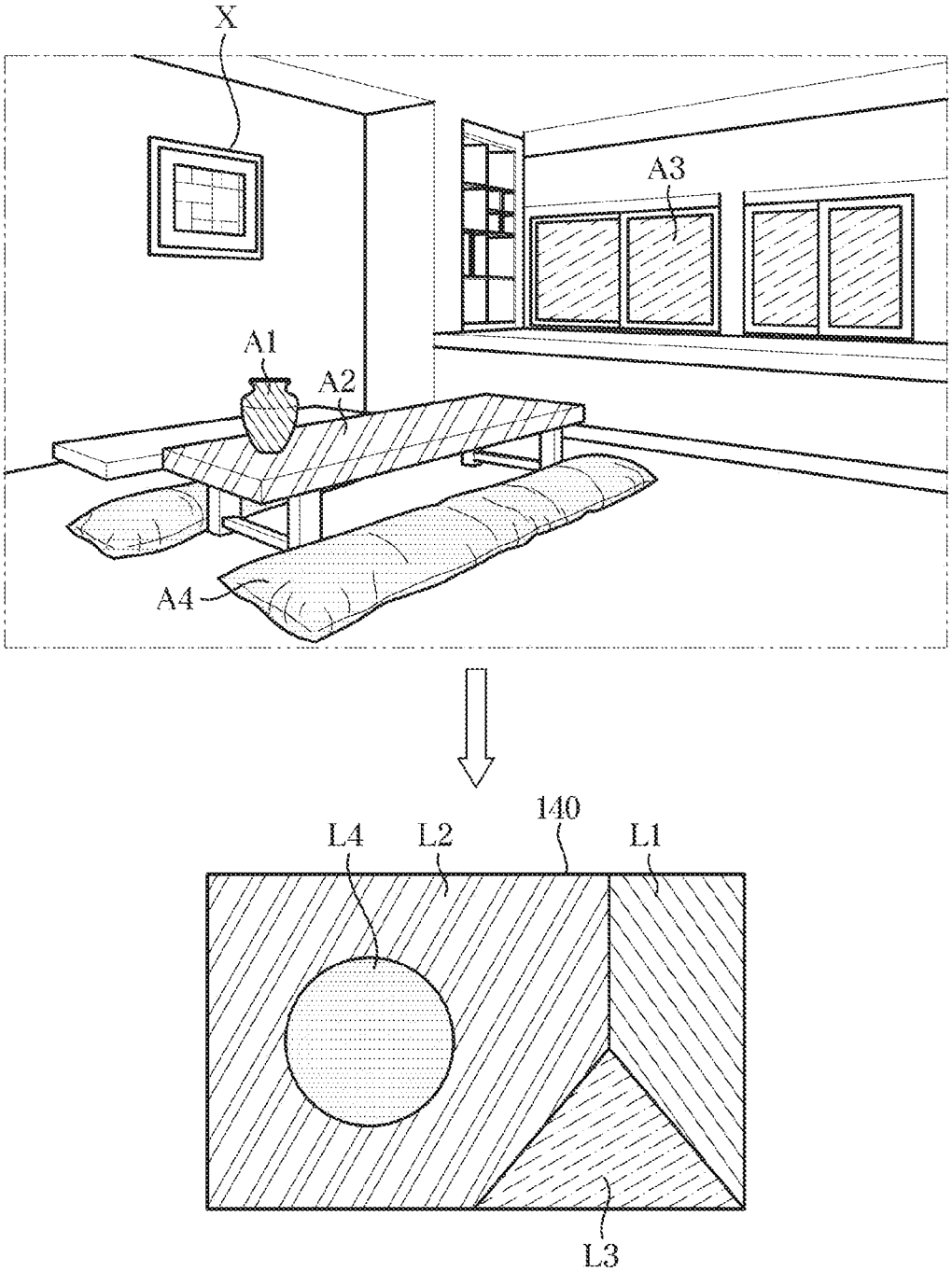
FIG. 4 is a view illustrating an operation of applying a color extracted from a received image of a display apparatus to a region, according to an embodiment of the disclosure.

FIG. 4 is a view for describing an operation of applying a color extracted from a received image of a display apparatus to a region, according to an embodiment of the disclosure.

Referring to FIG. 4, the controller 130 may extract at least one color included in the image from the image including the visual information about the surrounding environment of the display apparatus 100.

In this case, the image may refer to the image received from the external device or stored in the storage 150, and may refer to the image captured by the external device.

In addition, the image including the visual information about the surrounding environment of the display apparatus 100 may be the image including the display apparatus 100 that is, the image including the visual information about an appearance of the display apparatus 100, or may refer to the image that provides the visual information about the place where the display apparatus 100 is installed even through the display apparatus 100 is not included.

The controller 130 may extract colors for at least one region A1, A2, A3, and A4 included in the image. In this case, the regions A1, A2, A3, and A4 for color extraction may be distinguished in units of pixels, and may include at least one pixel.

The controller 130 may extract the color data for each pixel included in the image, and may identify the color corresponding to the pixel based on the extracted color data for each pixel.

The controller 130 may identify the number of pixels for each color based on the color data for each pixel, and may determine the color to be extracted from the image based on the number of pixels having the same color. That is, the controller 130 may determine the color to be extracted from the image based on the number of pixels having the same color data.

When the number of pixels having the same color data is equal to or greater than a predetermined number, the controller 130 may extract the color corresponding to the corresponding color data from the image. In this case, extracting the specific color may refer to an operation of obtaining the color data corresponding to the specific color from pixel information of the image, and may further include an operation of storing the obtained color data.

When a predetermined number or more of the pixels included in the image have the same color data, the color corresponding to the corresponding color data may be a main color included in the corresponding image.

The controller 130 may extract the main color included in the image by extracting the color data that the predetermined number or more of pixels among the pixels included in the image have in common. The controller 130 may generate the image in harmony with the surrounding environment by generating the image using the extracted color.

The controller 130 may extract the color data that the predetermined number or more of pixels among the pixels included in the specific region of the image have in common. In this case, the specific region may be a region including a predetermined number of adjacent pixels, and may be input from the user.

The controller 130 may classify the color extracted from the image into at least one group based on the color data corresponding to the corresponding color.

When different first and second colors are extracted from the image, the controller 130 may compare the color data of each of the first color and the second color, and may classify the first and second colors into the same group based on the comparison result. In this case, the first color and the second color may have different color data.

The controller 130 may calculate the difference of the color data for different colors, and may classify the different colors into the same group or different groups according to whether the calculated difference satisfies a predetermined classification condition.

In detail, the controller 130 may compare the difference of each parameter value of the color data corresponding to each of the different colors, and may classify the corresponding color into the same group when the difference between each of the calculated parameter value satisfies the predetermined classification condition. Alternatively, the controller 130 may classify the corresponding color into another group when the difference between each of the calculated parameter values does not satisfy the predetermined classification condition.

In this case, the color data may include at least one of HSV data or RGB data, and each of the parameter values of the color data is not only the parameter value of Red (R), Green (G), and Blue (B), but also the parameter value of Hue (H), Saturation (S) and Value (V). However, the disclosure is not limited to the color model, and data for various color models may be included according to an embodiment.

The controller 130 may calculate the difference between the HSV data of the first color and the HSV data of the second color. When the difference between the HSV data satisfies a predetermined first classification condition, the controller 130 may classify the first color and the second color into the same group.

In detail, the controller 130 may calculate the difference between each parameter value of the HSV data of the first color and the second color, and may classify the first color and the second color into the same group according to the difference. In this case, the first classification condition may refer to a condition for the difference between each parameter value.

For example, when the difference in the Hue (H) parameter value between the HSV data of the first color and the second color is 20° or less, the difference in the Saturation (S) parameter value is 50% or less, and the difference in the Value (V) parameter value is 50% or less, the controller 130 may classify the first color and the second color into the same group.

In this case, the first color having Hue (H) of 60°, Saturation (S) of 30%, and Value (V) of 80% and the second color having Hue (H) of 50°, Saturation (S) of 45%, and Value (V) of 60% may be classified into the same group.

The controller 130 may calculate the difference between the RGB data of the first color and the RGB data of the second color. When the difference between the RGB data satisfies a predetermined second classification condition, the controller 130 may classify the first color and the second color into the same group.

In detail, the controller 130 may calculate the difference between each parameter value of the RGB data of the first color and the second color, and may classify the first color and the second color into the same group according to the difference. In this case, the second classification condition may refer to a condition for the difference between each parameter value.

For example, when the difference between the parameter value having the largest value among the RGB data of the first color and the corresponding parameter value of the second color is 10 or less, and the sum of the differences between the first color and the second color for the remaining two parameter values is 50 or less, the controller 130 may classify the first color and the second color into the same group.

In this case, the first color having Red (R) of 200, Green (G) of 150, and Blue (B) of 180 and the second color having Red (R) of 195, Green (G) of 135, and Blue (B) of 160 may be classified into the same group.

Alternatively, when there is a color classified into a specific group, the controller 130 may compare the color data of the color extracted from the image and the color classified into the specific group, and may identify whether the extracted color is included in the corresponding group based on the comparison result. That is, the controller 130 may determine whether to classify the extracted color into the corresponding group based on the comparison result of the color data.

In this case, the controller 130 may compare the color data between the first color classified into the first group and the second color extracted from the image, and may determine whether to classify the second color into the first group based on the comparison result. The description thereof is the same as described above.

When the difference in the color data between the first color and the second color satisfies the predetermined classification condition, the controller 130 may add the second color to the first group. When the difference in the color data between the first color and the second color does not satisfy the predetermined classification condition, the controller 130 may generate a new second group and add the second color to the second group.

In this case, the controller 130 may store the generated group and information related to the color added to the group in the storage 150, and the information related to the color added to the group may include the color data included in the corresponding group.

Based on the classification result for the extracted color, the controller 130 may determine the color to be assigned to at least one region.

The controller 130 may determine the color to be assigned to at least one region based on the brightness or saturation of the group. The controller 130 may determine the group to be assigned to at least one region in order of brightness or saturation of the group, and may determine the color to be assigned to the corresponding region based on the color belonging to the determined group.

The controller 130 may arrange the groups, to which at least one color is assigned, in the order of brightness or saturation, and may arrange the colors included in each group in the order of brightness or saturation.

In detail, the controller 130 may determine the group to be assigned to the lowest region and the highest region based on the brightness of the group, and may determine the color included in the determined group as the color to be assigned to the lowest region and the highest region. In this case, the lowest region may refer to a region disposed at the bottom of at least one region constituting the specific pattern, and the highest region may refer to a region disposed at the top.

More particularly, the controller 130 may determine a group having the highest brightness among the groups, in which the at least one color is classified, as the group to be assigned to the lowest region, and may determine the color included in the group having the highest brightness as the color to be assigned to the lowest region.

At this time, the controller 130 may determine an average value of brightness for each of the color data corresponding to the color classified into one group as the brightness of the group. Alternatively, the controller 130 may determine the brightness of the brightest color among the at least one color included in the group as the brightness of the corresponding group.

The controller 130 may convert coordinate values between the color models. For example, when the color data specifying the extracted color is the RGB data, the controller 130 may convert the RGB data into the HSV data and identify the brightness of the corresponding color from the converted data.

The controller 130 may determine the color having the highest brightness among the colors included in the group having the highest brightness as the color to be assigned to the lowest region. Alternatively, the controller 130 may apply the predetermined weighted value based on the color data included in the group having the highest brightness, and may determine the color corresponding to the color data, to which the weighted value is applied, as the color to be assigned to the lowest region.

On the other hand, when the number of groups in which at least one color is classified and the number of groups generated as the classification result are greater than the number of regions for generating the specific pattern, the controller 130 may determine the group having the second highest brightness as the lowest region.

The controller 130 may determine the color included in the second highest group as the color to be assigned to the lowest region, except for the group having the highest brightness among the groups in which the at least one color is classified.

In this way, the controller 130 may prevent the white with the highest brightness from being collectively assigned to the lowest region, and may allow the colors of various brightness extracted from the image to be assigned to the region.

In addition, the controller 130 may determine the group having the lowest brightness among the groups in which the at least one color is classified as the group to be assigned to the highest region, and may determine the color included in the group having the lowest brightness as the color to be assigned to the lowest region.

The controller 130 may determine the color having the lowest brightness among the colors included in the group having the highest brightness as the color to be assigned to the highest region. Alternatively, the controller 130 may apply the predetermined weighted value based on the color data included in the group having the lowest brightness, and may determine the color corresponding to the color data to which the weighted value is applied as the color to be assigned to the highest region.

The controller 130 may determine the group to be assigned to a middle region based on the saturation of the group, and may determine the color included in the determined group as the color to be assigned to the middle region. In this case, the middle region may refer to at least one region disposed between the lowest region and the highest region among at least one region constituting the specific pattern.

The controller 130 may assign the color included in the group determined to be assigned to each middle region to the corresponding middle region. Alternatively, the controller 130 may apply the predetermined weighted value based on the color data included in the determined group, and may determine the color corresponding to the color data to which the weighted value is applied as the color to be assigned to the middle region.

In particular, the controller 130 may determine the group to be assigned to the middle region in the order of saturation of the group in which at least one color is classified, and may allow a higher saturation group to be assigned to a lower middle region. That is, the controller 130 may assign the color having the higher saturation to the lower middle region.

In other words, the controller 130 may determine a group having the highest saturation among the groups, in which the at least one color is classified, as the group to be assigned to a first middle region disposed at the bottom of the middle regions, and may determine the group having the second highest saturation as the group to be assigned to an upper region (hereinafter, referred to as "second middle region") of the first middle region at the bottom.

At this time, the controller 130 may determine an average value of saturation for each of the color data corresponding to the color classified into one group as the saturation of the group. Alternatively, the controller 130 may determine the saturation of the color with the highest saturation among the at least one color included in the group as the saturation of the corresponding group.

The controller 130 may convert coordinate values between the color models and identify the saturation of the corresponding color from the converted data. The description below is the same as described above.

Meanwhile, the controller 130 may determine a group to be assigned to the middle region based on the saturation of the group not assigned to the specific region among the generated groups. In detail, the controller 130 may determine a group to be assigned to the middle region based on the saturation of the group not assigned to the lowest region and the highest region.

The controller 130 may determine the group having the highest saturation among the groups not assigned to the lowest region and the highest region as the group to be assigned to the first middle region disposed at the bottom of the middle regions.

In this case, when all groups are assigned to the lowest region or the highest region, the controller 130 may determine the color to be assigned to the first middle region based on the color data of the group assigned to the lowest region.

In particular, the controller 130 may apply the predetermined weighted value to the color data corresponding to the specific color among at least one color included in the group assigned to the lowest region, and may determine the color corresponding to the color data, to which the weighted value is applied, as the color to be assigned to the first middle region.

Alternatively, the controller 130 may calculate the average value of the color data included in the group assigned to the lowest region, and may determine the color corresponding to the average value of the color data as the color to be assigned to the first middle region.

In this case, the controller 130 may receive the color data corresponding to the color to be assigned to the specific region or the weighted value to be applied to the color data from the user through the input device 120. The controller 130 may determine the color to be assigned to the region based on the input information.

When colors are assigned to the first middle region disposed at the bottom of the middle regions, the controller 130 may determine the group to be assigned to the second middle region which is the upper region of the first middle region based on the saturation of the group that is not assigned to the lowest region, the highest region, and the first middle region.

In particular, the controller 130 may determine the group having the highest saturation among the groups not assigned to the lowest region, the highest region, and the first middle region, as the group to be assigned to the second middle region.

In other words, the controller 130 may assign the color of the group with a higher saturation among the groups not assigned to the specific region to the lower middle region among the middle regions to which the specific color is not assigned.

On the other hand, when there is no group that is not assigned to the specific region even though there is the middle region to which the specific color is not assigned, the controller 130 may determine the color to be assigned to the second middle region based on the color data of the group assigned to the upper region of the lowest region, that is, the second lowest region.

In particular, the controller 130 may apply the predetermined weighted value to the color data corresponding to the specific color among at least one color included in the group assigned to the second lowest region, and may determine the color corresponding to the color data, to which the weighted value is applied, as the color to be assigned to the second middle region.

Alternatively, the controller 130 may calculate the average value of the color data included in the group assigned to the second lowest region, and may determine the color corresponding to the average value of the color data as the color to be assigned to the second middle region.

In this case, the user may input the weighted value to be applied to the color data or the color data corresponding to the color to be assigned to the specific region through the input device 120, and the description thereof is the same as described above.

The controller 130 may repeatedly perform the above-described operation until colors are assigned to all regions included in the specific pattern.

For example, as illustrated in FIG. 4, the image including the visual information about an appearance X of the display apparatus 100 may be received as the image of the surrounding environment of the display apparatus 100.

When different colors are extracted from four regions A1, A2, A3, and A4 included in the received image, and the colors corresponding to each of the four regions are classified into different groups, the controller 130 may assign the color of the group having the highest brightness to the first region L1 disposed at the lowest region.

In addition, the controller 130 may assign the color of the group having the lowest brightness to the fourth region L4 disposed at the top. The controller 130 may assign the group having the highest saturation among the groups, which are not assigned to the first region L1 and the fourth region L4, to the second region L2 disposed above the first region L1. Next, the controller 130 may assign the group having the highest saturation among the groups, which are not assigned to the first region L1, the second region L2, and the fourth region L4, to the third region L3 disposed above the second region L2.

Through this, the controller 130 may assign colors having different brightness or saturation to each region, and thus may apply more various colors to the region.

In particular, even when the received image includes a similar series of colors, the controller 130 may extract various colors, and may simultaneously generate the image based on patterns having various brightness or saturation. Therefore, the image that more appropriately reflects the surrounding environment of the display apparatus 100 may be generated, and thus user convenience may be increased.

Figure 5:
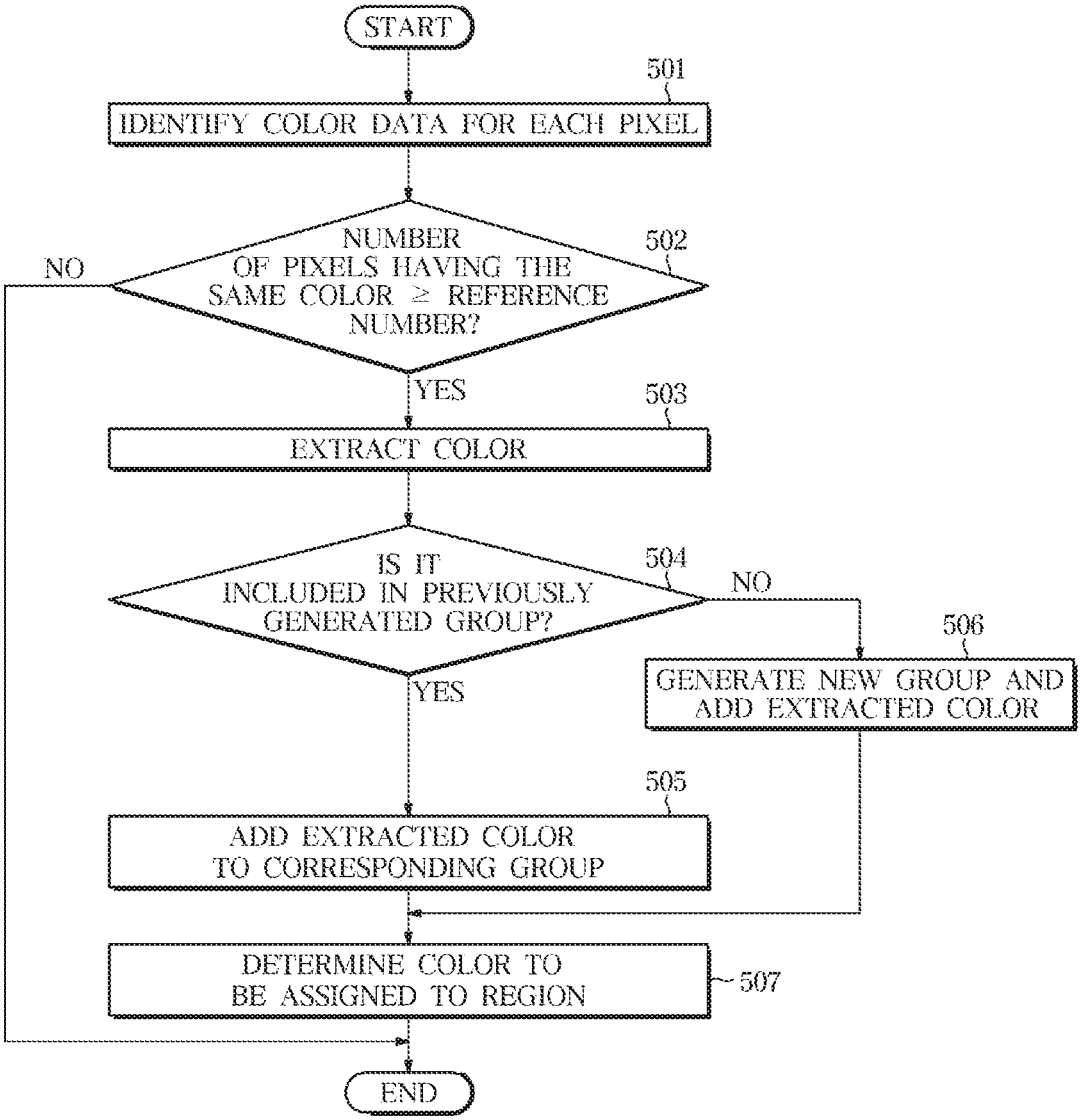
FIG. 5 is a flowchart illustrating a method of controlling a display apparatus according to an embodiment of the disclosure.

FIG. 5 is a flowchart illustrating a method of controlling the display apparatus according to an embodiment of the disclosure.

Referring to FIG. 5, the display apparatus 100 may identify the color data for each pixel included in the received image (501), and may identify whether the number of pixels having the same color is greater than or equal to the predetermined reference number (502).

In this case, the display apparatus 100 may receive the image captured by the external device from the paired external device, and the received image may include the image of the surrounding environment of the display apparatus 100. The image of the surrounding environment of the display apparatus 100 may be the image including the visual information about the surrounding environment of the display apparatus 100, and may refer to the image including the display apparatus 100 or the image that provides the visual information about the place where the display apparatus 100 is installed even through the display apparatus 100 is not included.

When the number of pixels having the same color is greater than or equal to the predetermined reference number, the display apparatus 100 may extract the color corresponding to the corresponding color data from the image (503).

In this case, the color data may refer to data for designating a specific color, and may refer to data for representing the color of each pixel included in the image. The color data may include coordinate values of standardized color models.

Further, the extraction of the specific color may refer to the operation of obtaining the color data corresponding to the specific color from pixel information of the image, and may further include the operation of storing the obtained color data.

At this time, the display apparatus 100 may extract the color data that the predetermined number or more of pixels among the pixels included in the specific region of the image have in common. In this case, the specific region may be the region including the predetermined number of adjacent pixels, and may be input from the user.

The display apparatus 100 may identify whether the extracted color is included in a previously generated group (504). Particularly, the group may refer to the group for classifying at least one color included in the image, and the previously generated group may refer to the group in which at least one extracted color is classified.

The display apparatus 100 may compare the color data of the color extracted from the image with the color data of each color classified into the previously generated group, and may identify whether the extracted color is included in the corresponding group based on the comparison result. That is, the display apparatus 100 may determine whether to classify the extracted color into the corresponding group based on the comparison result of the color data.

The display apparatus 100 may calculate the difference between color data for different colors, and may identify whether the extracted color is included in the previously generated group according to whether the calculated difference satisfies the predetermined classification condition.

In this case, the color data may include at least one of HSV data or RGB data, and each of the parameter values of the color data is not only the parameter value of Red (R), Green (G), and Blue (B), but also the parameter value of Hue (H), Saturation (S) and Value (V). However, the disclosure is not limited to the color model, and data for various color models may be included according to an embodiment.

The display apparatus 100 may calculate the difference between the HSV data (or RGB data) of the extracted color and the HSV data (or RGB data) of the color included in the previously generated group. When the difference between the HSV data (or RGB data) satisfies the first classification condition, the display apparatus 100 may identify that the extracted color is included in the previously generated group. That is, the extracted color may be classified into the corresponding group.

When it is identified that the extracted color is included in the previously generated group (YES in 504), the display apparatus 100 may add the extracted color to the corresponding group (505).

In this case, the display apparatus 100 may store the generated group and information related to the color added to the group in the storage 150, and the information related to the color added to the group may include the color data included in the corresponding group.

As another example, when it is identified that the extracted color is not included in the previously generated group (NO in 504), the display apparatus 100 may generate the new group for classifying the extracted color and add the extracted color to the new group (506).

Based on the classification result for the extracted color, the display apparatus 100 may determine the color to be assigned to at least one region (507).

In this case, the at least one region may refer to a display region for configuring the predetermined pattern, and may refer to at least one layer for displaying a specific image. Each of the at least one region may be displayed by a predetermined size, shape, arrangement order, and depth, or may be displayed based on a size, shape, arrangement order, and depth input from the user.

The pattern may be a pattern for color correction of the image output from the display 140, and may refer to an image itself output from the display 140.

Through this, the display apparatus 100 may extract various colors from the image. In particular, even when the image including the similar series of colors is received, various colors may be extracted, thereby increasing user convenience.

At the same time, since the display apparatus 100 may classify the various extracted colors into at least one group, even when a complex content is received, the display apparatus 100 may utilize the group of classified colors as a control basis, thereby increasing utilization. Therefore, the user's convenience may be increased.

Figure 6:
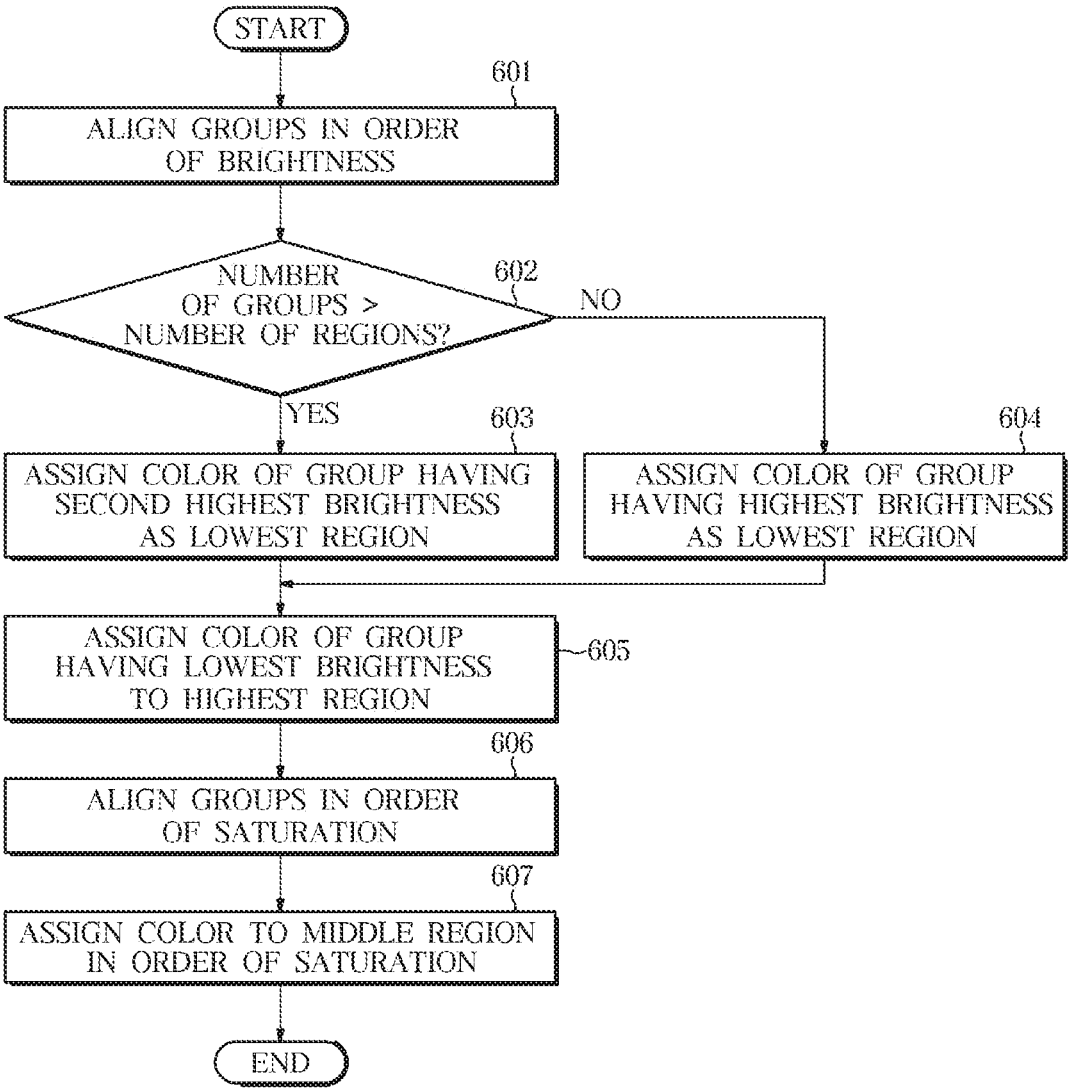
FIG. 6 is a flowchart illustrating a method of controlling a display apparatus according to another embodiment of the disclosure.

FIG. 6 is a flowchart illustrating a method of controlling a display apparatus according to another embodiment of the disclosure.

Referring to FIG. 6, the display apparatus 100 may align the groups in order of brightness (601). In this case, the group to be aligned may refer to the group in which at least one color extracted from the image is classified.

The display apparatus 100 may determine the average value of brightness for each of the color data corresponding to the color classified into one group as the brightness of the group. Alternatively, the display apparatus 100 may determine the brightness of the brightest color among the at least one color included in the group as the brightness of the corresponding group. In this case, the display apparatus 100 may convert coordinate values between the color models. For example, when the color data specifying the extracted color is the RGB data, the display apparatus 100 may convert the RGB data into the HSV data and identify the brightness of the corresponding color from the converted data.

Thereafter, the display apparatus 100 may identify whether the number of groups in which at least one color is classified is greater than the number of regions (602). In this case, the region may refer to the region for configuring the predetermined pattern. The pattern may be the pattern for color correction of the image output from the display apparatus 100, and may refer to the image itself output from the display apparatus 100.

When the number of groups in which at least one color is classified and the number of groups generated as the classification result are greater than the number of regions for generating the specific pattern (YES in 602), the display apparatus 100 may assign the color of the group having the second highest brightness to the lowest region (603).

The display apparatus 100 may determine the color having the highest brightness among the colors included in the group having the second highest brightness as the color to be assigned to the lowest region. Alternatively, the display apparatus 100 may apply the predetermined weighted value based on the color data included in the group having the second highest brightness, and may determine the color corresponding to the color data to which the weighted value is applied as the color to be assigned to the lowest region.

In this way, the controller 130 may prevent the white with the highest brightness from being collectively assigned to the lowest region, and may allow the colors of various brightness extracted from the image to be assigned to the region.

As another example, when the number of groups generated is less than the number of regions for generating the specific pattern (NO in 602), the display apparatus 100 may assign the color of the group having the highest brightness to the lowest region (604).

In this case, the display apparatus 100 may determine the color having the highest brightness among the colors of the group having the highest brightness as the color to be assigned to the lowest region. Alternatively, the display apparatus 100 may apply the predetermined weighted value based on the color data included in the group having the highest brightness, and may determine the color corresponding to the color data to which the weighted value is applied as the color to be assigned to the lowest region.

Thereafter, the display apparatus 100 may assign the color of the group having the lowest brightness to the highest region (605). In this case, the display apparatus 100 may determine the color having the lowest brightness among the colors included in the group having the lowest brightness as the color to be assigned to the highest region. Alternatively, the display apparatus 100 may apply the predetermined weighted value based on the color data included in the group having the lowest brightness, and may determine the color corresponding to the color data, to which the weighted value is applied, as the color to be assigned to the highest region.

After assigning the specific color to the highest region, the display apparatus 100 may align the groups in order of saturation (606). In this case, the group aligned in saturation order may refer to all generated groups, or may refer to the group not assigned to the lowest region and the highest region.

The display apparatus 100 may assign the color to the middle region in order of saturation of the group (607). In this case, the middle region may refer to at least one region disposed between the lowest region and the highest region among at least one region constituting the specific pattern.

In particular, the display apparatus 100 may assign the color included in the group determined to be assigned to each middle region to the corresponding middle region. Alternatively, the display apparatus 100 may apply the predetermined weighted value based on the color data included in the determined group, and may determine the color corresponding to the color data to which the weighted value is applied as the color to be assigned to the middle region.

The display apparatus 100 may determine the group to be assigned to the middle region in the order of saturation of the group in which at least one color is classified, and may allow a higher saturation group to be assigned to a lower region among the middle regions. That is, the display apparatus 100 may assign the color having the higher saturation to the lower region among the middle regions.

In other words, the display apparatus 100 may determine a group having the highest saturation among the groups in which the at least one color is classified as the group to be assigned to a first middle region disposed at the bottom of the middle regions, and may determine the group having the second highest saturation as the group to be assigned to the second middle region which is the upper region of the first middle region at the bottom.

At this time, the display apparatus 100 may determine an average value of saturation for each of the color data corresponding to the color classified into one group as the saturation of the group. Alternatively, the display apparatus 100 may determine the saturation of the color with the highest saturation among the at least one color included in the group as the saturation of the corresponding group.

The display apparatus 100 may convert coordinate values between the color models and identify the saturation of the corresponding color from the converted data. The description below is the same as described above.

Meanwhile, in operation 607, the display apparatus 100 may determine the group to be assigned to the middle region based on the saturation of the group not assigned to the specific region among the generated groups. In detail, the display apparatus 100 may determine the group to be assigned to the middle region based on the saturation of the group not assigned to the lowest region and the highest region.

The display apparatus 100 may determine the group having the highest saturation among the groups, which are not assigned to the lowest region and the highest region, as the group to be assigned to the first middle region disposed at the bottom of the middle regions.

In this case, when there are no groups not assigned to the lowest region and the highest region, the display apparatus 100 may determine the color to be assigned to the first middle region based on the color data of the group assigned to the lowest region.

In particular, the display apparatus 100 may apply the predetermined weighted value to the color data corresponding to the specific color among at least one color included in the group assigned to the lowest region, and may determine the color corresponding to the color data to which the weighted value is applied as the color to be assigned to the first middle region.

Alternatively, the display apparatus 100 may calculate the average value of the color data included in the group assigned to the lowest region, and may determine the color corresponding to the average value of the color data as the color to be assigned to the first middle region.

Meanwhile, in operations 603, 604, 605, and 607, the display apparatus 100 may receive the color data corresponding to the color to be assigned to the specific region or the weighted value to be applied to the color data from the user through the input device 120. The display apparatus 100 may determine the color to be assigned to the region based on the input information.

The display apparatus 100 may repeatedly perform the above-described operation until colors are assigned to all regions included in the specific pattern.

Through this, the display apparatus 100 may assign colors having different brightness or saturation to each region, and thus may apply more various colors to the region.

In particular, even when the received image includes a similar series of colors, the display apparatus 100 may extract various colors, and may simultaneously generate the image based on patterns having various brightness or saturation. Therefore, the image that more appropriately reflects the surrounding environment of the display apparatus 100 may be generated, and thus user convenience may be increased.

According to the display apparatus and the method of controlling the display apparatus of exemplary embodiments, since colors having different brightness or saturation can be assigned to each region, the image that more appropriately reflects the surrounding environment may be generated, thereby increasing user convenience.

Meanwhile, the disclosed embodiments may be implemented in the form of a recording medium storing instructions that are executable by a computer. The instructions may be stored in the form of a program code, and when executed by a processor, the instructions may generate a program module to perform operations of the disclosed embodiments. The recording medium may be implemented non-transitory as a computer-readable recording medium.

The non-transitory computer-readable recording medium may include all kinds of recording media storing commands that can be interpreted by a computer. For example, the non-transitory computer-readable recording medium may be, for example, ROM, RAM, a magnetic tape, a magnetic disc, flash memory, an optical data storage device, etc.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A display apparatus comprising:

communication circuitry configured to communicate with an external device;

a display; and a controller configured to:

control the communication circuitry to perform pairing of the display apparatus with the external device;

control the communication circuitry to receive, from the paired external device, an image including visual information about surrounding of the display apparatus;

extract a plurality of colors from the received image, each of the plurality of colors corresponding to respective same color data, when a number of pixels in the received image including the respective same color data is greater than or equal to a predetermined number;

classify the plurality of colors into a plurality of groups based on the color data of the plurality of colors extracted from the received image;

among the plurality of groups, determine a first group to be assigned to a first layer and a second group to be assigned to a second layer based on at least one of brightness or saturation of the plurality of groups;

determine a first color to be applied to the first layer based on at least one color included in the first group and a second color to be applied to the second layer based on at least one color included in the second group;

apply the first color and the second color to the first layer and the second layer respectively;

generate an image including a plurality of layers comprising the first layer and the second layer; and control the display to display the generated image.

2. The display apparatus according to claim 1, wherein the image received from the external device is an image including the display apparatus.

3. The display apparatus according to claim 1, wherein the controller is configured to extract a color corresponding to a first color data in response to the number of pixels in the received image including the first color data being greater than or equal to the predetermined number.

4. The display apparatus according to claim 1, wherein the controller is configured to compare the color data of each of a third color and a fourth color extracted from the received image, and to classify the third color and the fourth color into the same group based on a result of the comparison.

5. The display apparatus according to claim 1, wherein in case that the first layer is a lowest layer and the second layer is a highest layer, the controller is configured to determine the first group and the second group based on the brightness of the plurality of groups.

6. The display apparatus according to claim 5, wherein the controller is configured to determine a group having the highest brightness as the first group, and to determine a group having the lowest brightness as the second group.

7. The display apparatus according to claim 5, wherein the controller is configured to determine a group having the second highest brightness as the first group when a number of groups is greater than a number of layers.

8. The display apparatus according to claim 1, wherein in case that the first layer and the second layer are middle layers, the controller is configured to determine the first group and the second group based on the saturation of the plurality of groups.

9. The display apparatus according to claim 8, wherein in case that the first layer is disposed at the bottom of the second layer, the controller is configured to determine a group having the highest saturation as the first group, and to determine a group having the second highest saturation as the second group.

10. The display apparatus according to claim 8, wherein the controller is configured to determine the first group and the second group to be assigned to the middle layers in order of saturation of the group among groups not assigned to the lowest layer and the highest layer.

11. The display apparatus according to claim 10, wherein the controller is configured to select the color to be assigned to the middle layers based on the color data of the group assigned to the lowest layer when there are groups assigned to the lowest layer and the highest layer.

12. The display apparatus according to claim 1, wherein the controller is configured to apply a predetermined weighted value to each of the plurality of layers, and to generate the image by merging the plurality of layers to which the weighted value is applied.

13. The display apparatus according to claim 1, further comprising:

an input device configured to receive from a user at least one of a number, shape, order, and weighted values of the plurality of layers, or the color data to be applied to the plurality of layers.

14. The display apparatus according to claim 1, wherein the image received from the external device is an image not including the display apparatus.

15. A method of controlling a display apparatus including communication circuitry, a controller, and a display, the method comprising:

performing, by the communication circuitry, pairing of the display apparatus with an external device;

receiving, by the communication circuitry from the paired external device, an image including visual information about surrounding of the display apparatus;

extracting, by the controller, a plurality of colors from the received image, each of the plurality of colors corresponding to respective same color data, when a number of pixels in the received image including the respective same color data is greater than or equal to a predetermined number;

classifying, by the controller, the plurality of colors into a plurality of groups based on the color data of the plurality of colors extracted from the received image;

among the plurality of groups, determining, by the controller, a first group to be assigned to a first layer and a second group to be assigned to a second layer based on at least one of brightness or saturation of the plurality of groups;

determining, by the controller, a first color to be applied to the first layer based on at least one color included in the first group and a second color to be applied to the second layer based on at least one color included in the second group;

applying, by the controller, the first color and the second color to the first layer and the second layer respectively;

generating, by the controller, an image including a plurality of layers comprising the first layer and the second layer; and displaying, by the display, the generated image.

16. The method according to claim 15, wherein the determining of the first group and the second group comprises:

in case that the first layer is a lowest layer and the second layer is a highest layer, determining, by the controller, the first group and the second group based on the brightness of the plurality of groups.

17. The method according to claim 15, wherein the determining of the first group and the second group comprises:

in case that the first layer and the second layer are middle layers, determining, by the controller, the first group and the second group based on the saturation of the plurality of groups.

18. The method according to claim 15, wherein the image received from the external device is an image not including the display apparatus.

* * * * *